US008888564B1

(12) United States Patent
Wood

(10) Patent No.: US 8,888,564 B1
(45) Date of Patent: Nov. 18, 2014

(54) POWER SANDER FOR CONFINED VERTICAL SURFACES

(76) Inventor: Robert Wood, Aston, PA (US)

( * ) Notice: Subject to any disclaimer, the term of this patent is extended or adjusted under 35 U.S.C. 154(b) by 255 days.

(21) Appl. No.: 13/479,260

(22) Filed: May 23, 2012

(51) Int. Cl.
*B24B 55/10* (2006.01)

(52) U.S. Cl.
USPC ..... 451/354; 451/350; 451/353; 451/361

(58) Field of Classification Search
CPC ..... B24B 55/10; B24B 7/182; B24B 23/04; B24B 23/043; B24B 23/028
USPC ..... 451/344–359, 361
See application file for complete search history.

(56) References Cited

U.S. PATENT DOCUMENTS

| | | | | | |
|---|---|---|---|---|---|
| 1,641,130 | A * | 8/1927 | Elliott | 474/60 |
| 2,097,806 | A * | 11/1937 | Weidrich | 451/353 |
| 2,242,229 | A * | 5/1941 | Burleigh | 451/353 |
| 2,629,210 | A * | 2/1953 | Robinson | 451/353 |
| 3,648,413 | A * | 3/1972 | Godwin et al. | 451/358 |
| 4,688,289 | A * | 8/1987 | Urakami | 15/98 |
| 4,754,580 | A * | 7/1988 | Mattson | 451/353 |
| 4,756,042 | A * | 7/1988 | Genovese et al. | 15/98 |
| 5,142,826 | A * | 9/1992 | Zhang | 451/344 |
| 5,365,626 | A * | 11/1994 | Santi | 15/49.1 |
| 5,545,080 | A * | 8/1996 | Clowers et al. | 451/359 |
| 5,545,082 | A * | 8/1996 | Courson et al. | 451/456 |
| 5,890,954 | A * | 4/1999 | Barous | 451/350 |
| 6,729,949 | B1 * | 5/2004 | McCoy | 451/523 |
| 7,247,085 | B1 * | 7/2007 | Anderson | 451/350 |
| 7,261,623 | B1 * | 8/2007 | Palushi | 451/350 |
| 2005/0159091 | A1 * | 7/2005 | Norton | 451/354 |

* cited by examiner

*Primary Examiner* — George Nguyen
(74) *Attorney, Agent, or Firm* — LaMorte & Associates, P.C.

(57) ABSTRACT

A hand-held edge sander that is adapted to sand vertical surfaces near a corner. The edge sander is a portable power hand tool that has an electric motor mounted within a casing. The electric motor is used to move a sanding head. The sanding head has a flat surface designed to retain a flat piece of sandpaper thereon. The flat surface of the sanding head exists in a first plane. The first plane remains constant as the edge sander is in operation and the sanding head is moved by the electric motor. Wheels are mounted to the casing for supporting the casing during the operation of the edge sander. The wheels are oriented to rotate in a plane that is parallel to the flat surface of the sanding head.

17 Claims, 5 Drawing Sheets

POWER SANDER FOR CONFINED VERTICAL SURFACES

BACKGROUND OF THE INVENTION

1. Field of the Invention

In general, the present invention relates to edge sanders that are used to sand a surface immediately adjacent a corner to a perpendicular surface. More particularly, the present invention relates to edge sanders with wheels or rollers that enable the sander to move smoothly across the surface being sanded.

2. Prior Art Description

Many commercial and residential buildings have flooring made of wood. Often the wood flooring is stained or painted a certain color and finished with a polyurethane or similar protective coating. Over time, the finish of the flooring wears away. Once the protective coating wears away, the paint or stain is exposed to water. As the paint or stain wears away, the floor develops bald spots where bare wood is exposed. This detracts from the aesthetics of the flooring. In order to repair the flooring and restore it to its original beauty, the flooring must be refinished. Flooring must be similarly refinished if a property owner decides that the color of the flooring needs to be changed, or if flooring with a painted finish is to be changed to a stained finish.

In order to refinish wood flooring, the existing layers of stain, paint and/or protective coatings must be removed to get down to the level of the bare underlying wood. The removal of such material is typically done using power sanders. Power sanders move a pad or belt of sand paper against the flooring. This physically removes the finish of the flooring until the underlying bear wood is exposed. When refinishing a floor, the majority of the flooring is sanded using large floor sanders. Floor sanders are large machines that remove the finish of the floor in unobstructed areas where the floor sanders can operate. Smaller edge sanders are then used to remove the finish of the flooring in areas against the walls and other confined areas where the larger floor sanders cannot operate.

Edge sanders come in a large variety of sizes and shapes. However, professional grade edge sanders operate at significant horsepower in order to remove material quickly. Consequently, commercial grade edge sanders tend to have larger, heavier motors than do other handheld sanders. Due to the large, heavy motors used by commercial grade edge sanders, it is common for the sander to have wheels or rollers that help support the weight of the edge sander, when the edge sander is in use. Professional grade edge sanders with support wheels are exemplified by U.S. Pat. No. 5,890,954 to Barous, entitled Floor Edges And Sanders.

In such prior art edge sanders, the edge sanders are designed so that the weight of the motors and housings are directly above the sanding heads. In this manner, the weight of the edge sander helps bear the sanding head against the surface being sanded. The wheels that help support the weight of the edge sander are positioned in the same plane as the sanding head, at points just adjacent the sanding head. In this manner, the wheels can help maintain the sander in an upright position without preventing the sanding head from being pressed against the surface being sanded. However, it has been discovered that in certain applications, the conventional prior art configuration of an edge sander can be detrimental to the proper operations of the edge sander.

In many buildings, often a staircase must be refinished along with the flooring because both the flooring and the staircase are stained or painted in the same style. On a flight of stairs, there are horizontal treads and vertical risers. The top surface of the horizontal treads can be sanded in a conventional manner using a conventional edge sander. However, the vertical risers cannot. In order to sand a vertical riser with an edge sander, the edge sander must be turned on its side. The weight of the edge sander must therefore be borne completely by the hands of the person operating the edge sander. Furthermore, the wheels on the edge sander cause interference by contacting the tread below the sander and/or the tread overhang above the sander. Many edge sanders are also just too large to fit between the treads to two adjacent stairs. If the edger sander does fit, it often becomes very difficult to evenly move the edge sander along the length of the riser, without the edge sander tipping and marring the surface of the riser. It is for this reason that professional floor refinishers prefer not to use edge sanders on stair risers. Rather, they opt for smaller, weaker palm sanders that can be better held in a vertical orientation. This adds significantly to the time, labor and cost associated with preparing stairs for refinishing.

A need therefore exists for a high-power sander that is specifically designed to sand stair risers and other confined vertical surfaces. These needs are met by the present invention as described and claimed below.

SUMMARY OF THE INVENTION

The present invention is a hand-held edge sander that is adapted to sand vertical surfaces near the corner where that vertical surface meets an adjacent horizontal surface. The edge sander is a portable power hand tool that has an electric motor mounted within a casing. The electric motor is used to move a sanding head. The sanding head has a flat surface designed to retain a flat piece of sandpaper thereon. The flat surface of the sanding head exists in a first plane. The first plane remains constant as the edge sander is in operation and the sanding head is moved by the electric motor.

Wheels are mounted to the casing for supporting the casing during the operation of the edge sander. The wheels are oriented to rotate in a plane that is parallel to the flat surface of the sanding head.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention edge sander can be embodied in many ways, the embodiment illustrated only shows a single exemplary embodiment. This embodiment is selected in order to set forth one of the best modes contemplated for the invention. The illustrated embodiment, however, is merely exemplary and should not be considered a limitation when interpreting the scope of the appended claims.

Figure 1:
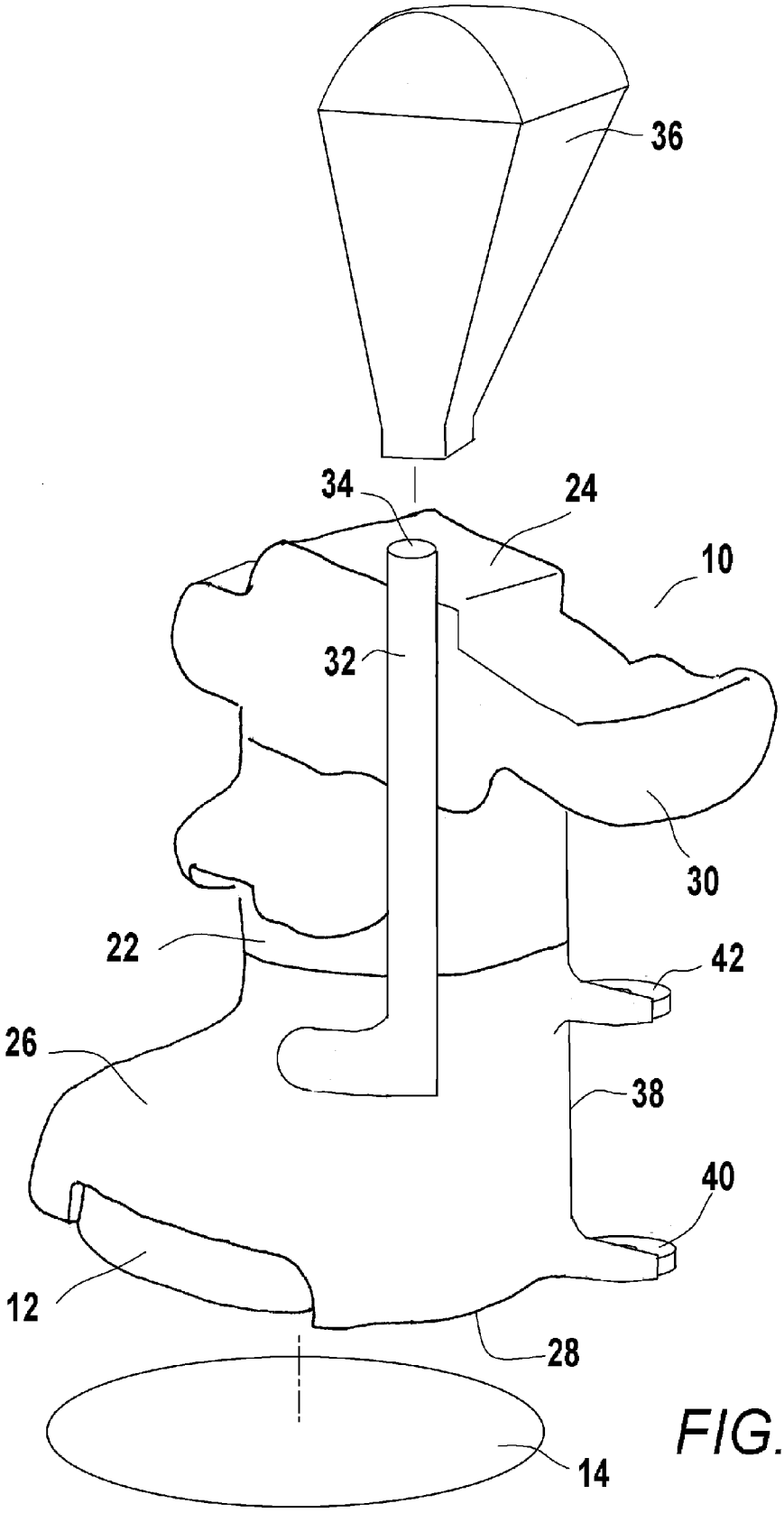
FIG. 1 is a perspective view of an exemplary embodiment of an edge sander in accordance with the present invention.
Figure 2:
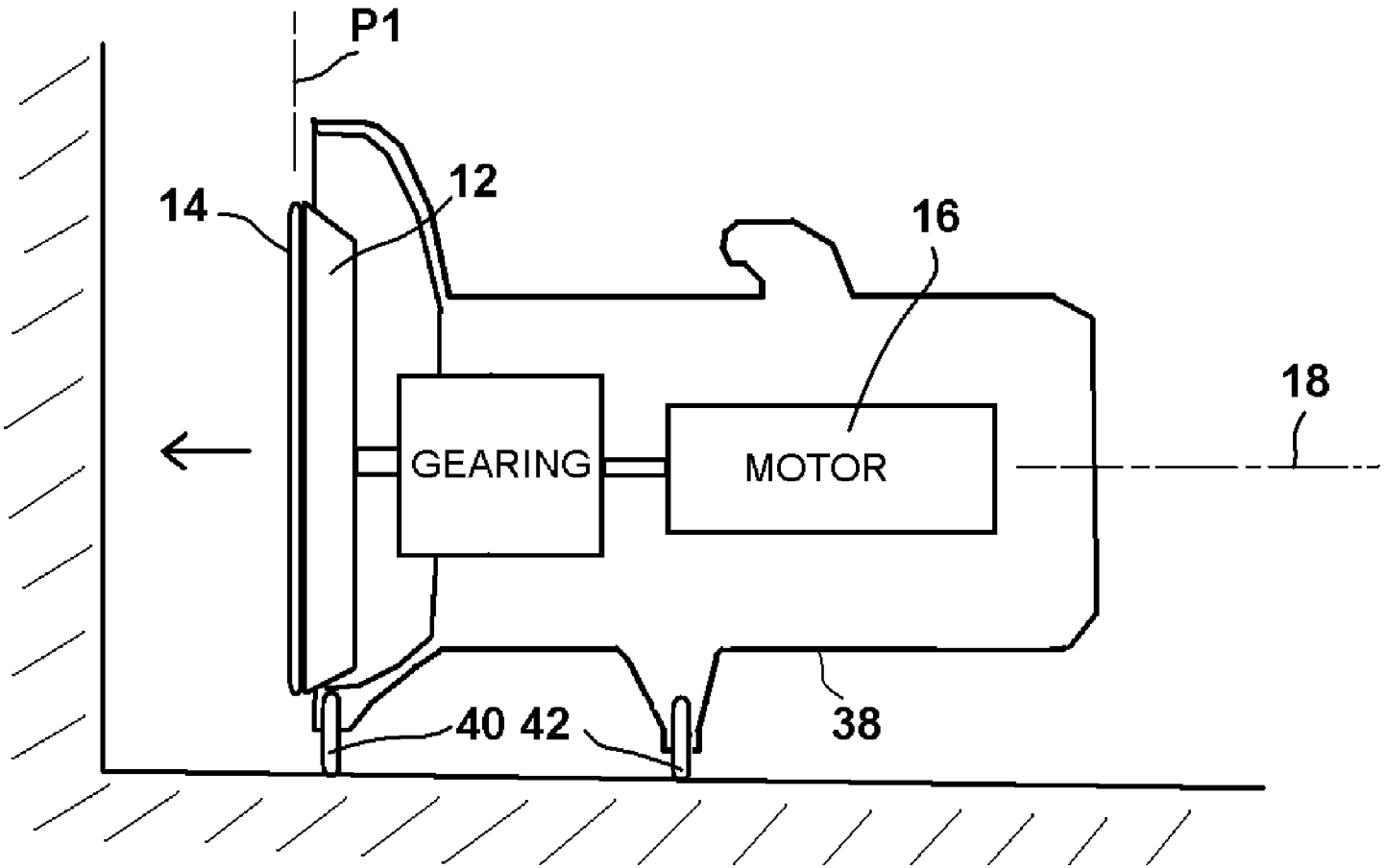
FIG. 2 is a side schematic view of the embodiment of FIG. 1.
Figure 3:
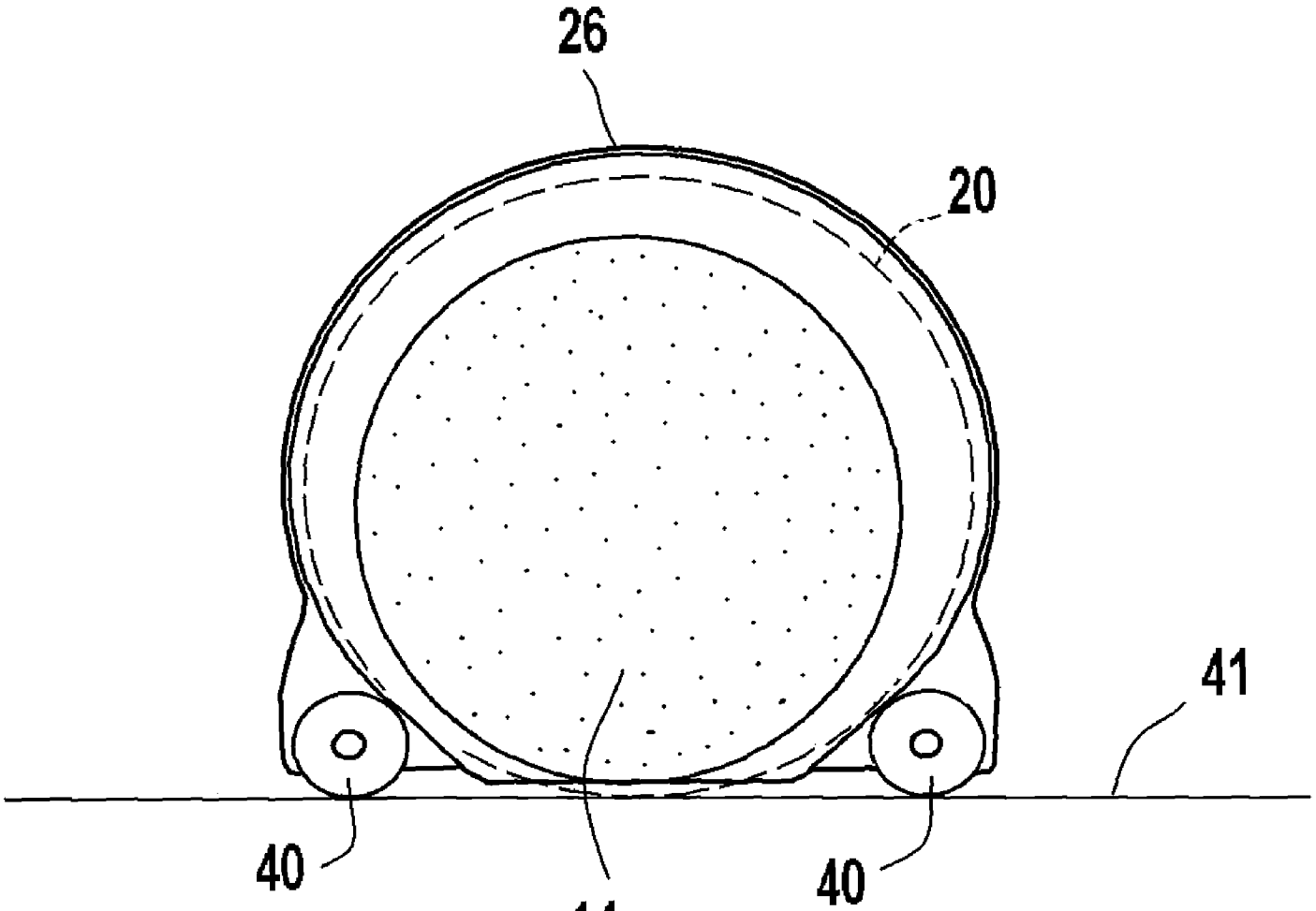
FIG. 3 is a bottom view of the embodiment of FIG. 1.

Referring to FIG. 1 in conjunction with both FIG. 2 and FIG. 3, a professional grade edge sander 10 is shown that is specifically designed to sand the risers on stairs, baseboard moldings, and other vertical surfaces that are conjoined at corners to adjacent horizontal surfaces. The edge sander 10 has a sanding head 12 that retains a replaceable piece of sandpaper 14. The sanding head 12 holds the sandpaper 14 in a first plane P1. The sanding head 12 is rotated by an internal motor 16 that rotates about a rotational axis 18. The motor 16 is preferably between one and three horsepower and has a rotational speed of between 10,000 RPMs and 30,000 RPMs. The rotational axis 18 of the motor 16 is perpendicular to the first plane P1 of the sandpaper 14.

In the exemplary embodiment, the sanding head 12 rotates the sandpaper 14 while simultaneously oscillating the sandpaper 14 through a circular sanding area 20 as the edge sander 10 is in use. The sandpaper 14 remains within the first plane P1 as the sandpaper 14 moves through the circular sanding area 20.

The edge sander 10 has a primary casing 22 that has a top end 24. The bottom of the primary casing 22 terminates in a bell housing 26 that surrounds most of the sanding head 12. The bell housing 26 has an open bottom 28. The sanding head 12 extends slightly beyond the open bottom 28 of the bell housing 26. As a result, the bell housing 26 does not interfere with the ability of the sandpaper 14 to contact a surface, yet the bell housing 26 can capture most of the debris created by the sanding procedure. The rotational axis 18 of the motor 16 generally extends through the center of the primary casing 22, although the flared area of the bell housing 26 can be slightly offset from the rotational axis 18 to allow for the oscillating motions.

Handles 30 extend outwardly from the primary casing 22. The handles 30 contain the operational controls to turn the edge sander 10 on and off. The handles 30 also provide safe surfaces where an operator can place his/her hands during the operation of the edge sander 10. A debris exhaust channel 32 is provided. The debris exhaust channel 32 draws air and sanding debris out of the bell housing 26 and exhausts that material out of an exit port 34. The exit port 34 is positioned above the top end 24 of the primary casing 22, so that debris is exhausted in the same direction as the rotational axis 18 beyond the top end 24 of the housing 26. A collection bag 36 can be provided to collect the sanding debris that is exhausted.

The primary casing 22, including the flared bell housing 26, has a rear surface 38 that is flattened. At least one set of wheels extends from the primary casing 22 beyond the flattened side. In the shown embodiment, two sets of wheels are shown, which include primary wheels 40 and secondary wheels 42. Although both primary wheels 40 and the secondary wheels 42 are shown, different models of the present invention edge sander may only include the primary wheels 22.

From FIG. 3, it can be seen that the primary wheels 40 are oriented on either side of the bell housing 26. Both primary wheels 40 are oriented in the same plane as the open end of the bell housing 26. As a consequence, both of the primary wheels 40 roll in the same plane. The primary wheels 40, therefore, roll in a plane that is parallel to the first plane P1 (FIG. 2) in which the sandpaper rotates. Furthermore, when the edge sander 10 is placed upon a horizontal surface, such as a stair tread, both primary wheels 40 roll on the horizontal surface along a common line 41 and help support the weight of the edge sander 10. The primary wheels 40 support the bell housing 26 so that the circular sanding area 20 in which the sandpaper 14 rotates intersects the horizontal surface at a tangent. Consequently, the horizontal surface acts as a tangent line to both primary wheels 40 and the circular sanding area 20 in which the sandpaper 14 rotates.

The secondary wheels 42, if present, also support the primary casing 22 so that the sandpaper 14 is oriented in the vertical during operation. If the secondary wheels 42 are not provided, a user manually supports the primary casing 22 using the handles 30. This orientation is easily maintained because much of the weight of the edge sander 10 is borne by the primary wheels 40.

The primary wheels 40 and the optional secondary wheels 42 are oriented to run along an underlying horizontal surface as the sandpaper 14 presses flush against the adjacent vertical surface. Contact between the vertical surface and the sandpaper 14 can therefore be maintained as the edge sander 10 is rolled along the length of the horizontal surface.

Figure 4:
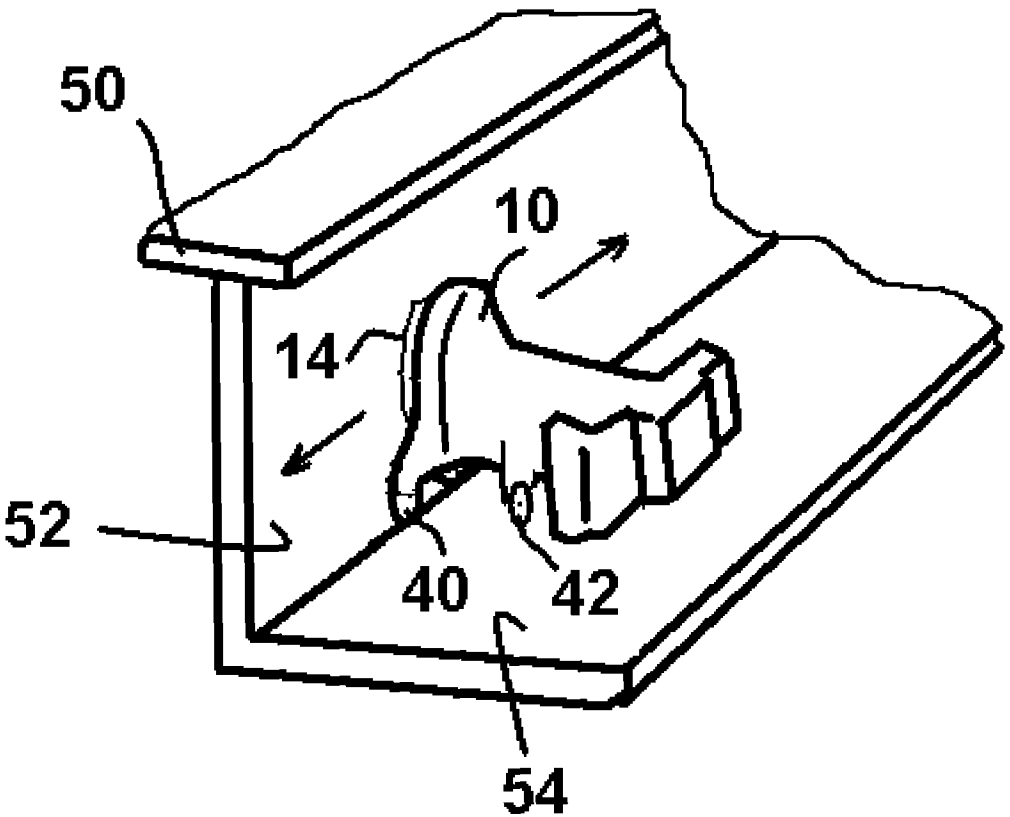
FIG. 4 is a perspective view of the exemplary embodiment of FIG. 1 shown sanding a riser on a set of stairs.

Referring now to FIG. 4, in conjunction with FIGS. 1, 2 and 3, the method of operating the edge sander 10 is explained in an application where it is being used to sand a riser 52 on a set of stairs 50. To sand the riser 52, the edge sander 10 is placed on the horizontal stair tread 54 that lays adjacent the riser 52. The riser 52 and the tread 54 intersect at a perpendicular. The edge sand 10 is oriented so that the sanding head 12 holds the sandpaper 14 in the vertical plane, and thus parallel to the riser 52. In this orientation, the primary wheels 40 and secondary wheels 42 (if present) are brought to rest on the tread 54. The primary wheels 40 and secondary wheels 42 support the weight of the edge sander 10. As the wheels 40, 42 rest upon the tread 54, the circular sanding area 20 (FIG. 2) affected by the sandpaper 14 descends to the same level as the bottom of the wheels 40, 42. Consequently, the sandpaper 14 can sand the riser 52 down to the level of the tread 54 while the edge sander 10 is resting on the tread 54.

The edge sander 10 is activated, therein causing the sandpaper 14 to move through the circular sanding area 20. The sandpaper 14 is then manually brought into contact with the riser 52. The sandpaper 14 can remain parallel to the riser 52 and in contact with the riser 52 as the edge sander 10 is rolled along the length of the riser 52. The sandpaper 14 can therefore be maintained perfectly parallel to the riser 52 and in contact with the riser 52 as the sandpaper 14 moves across the length of the riser 52. The result is an edge sander 10 that can sand risers and similar surfaces quickly and efficiently.

Figure 5:
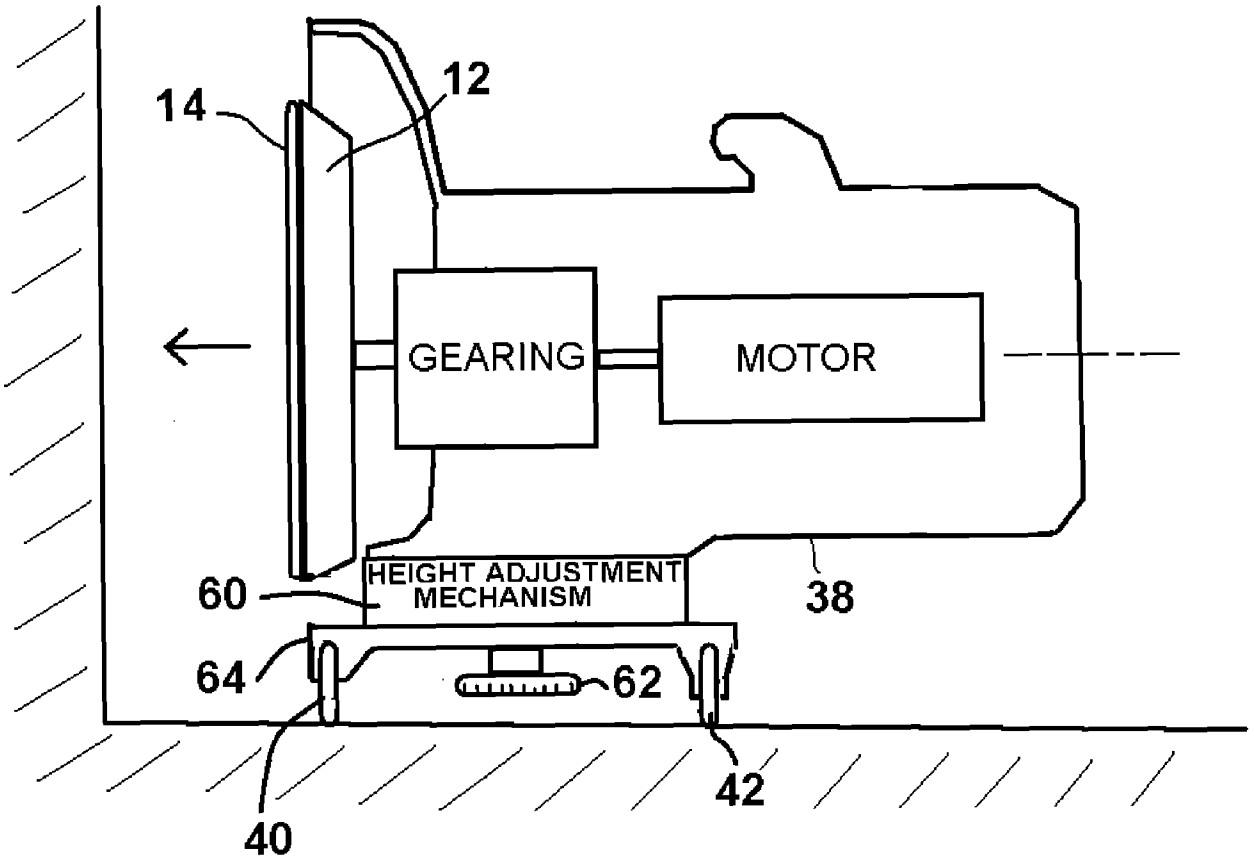
FIG. 5 is a side schematic view of and alternate embodiment that includes a sanding height adjustment mechanism.

In the embodiment previously described, the primary wheels 40 and the secondary wheels 42 are set at fixed positions. However, this need not be the case. Referring to FIG. 5, it can be seen that the primary wheels 40 and the secondary wheels 42 can be attached to a common platform 64. The platform 64 can be raised and lowered using a height adjustment mechanism 60. The height adjustment mechanism 60 is operated by manually turning an adjustment knob 62. In this manner, the height at which the sanding pad 12 and the sandpaper 14 are supported can be selectively adjusted. This adjustment feature is useful for sanding the top portion of a riser on a set of stairs.

It will be understood that the embodiment of the present invention that is illustrated and described is merely exemplary and that a person skilled in the art can make many variations to that embodiment. For instance, the shape of the primary casing, the bell housing and the handles can be varied as a matter of design choice. All such modifications are intended to be included within the scope of the present invention as defined by the claims.

What is claimed is:

1. A hand-held edge sander comprising:

casing having a top end, a bottom end, and a rear surface that extends between said top end and said bottom end;

an electric motor held within said casing;

a sanding head that is moved by said electric motor, wherein said sanding head has a flat surface that retains a flat piece of sandpaper thereon in a first plane as said sanding head is moved by said electric motor; and at least one wheel mounted to said rear surface of said casing for supporting said casing during operation of said edge sander, wherein said at least one wheel rotates in a plane that is parallel to said flat surface of said sanding head so that said flat surface of the sanding head will be vertically oriented when said the wheels rest on a horizontal surface.

2. The edge sander according to claim 1, wherein said at least one wheel includes a set of primary wheels that rotate in a first common plane, wherein said first common plane is parallel to said flat surface of said sanding head.

3. The edge sander according to claim 2, wherein said at least one wheel includes a set of secondary wheels, wherein said secondary wheels rotate in a second common plane that is parallel to said first common plane.

4. The edge sander according to claim 2, wherein said sanding head is moved through a circular pattern by said electric motor when said edge sander is in operation.

5. The edge sander according to claim 4, wherein said circular pattern and said set of primary wheels share a common tangent plane.

6. The edge sander according to claim 1, further including at least one handle that extends from said casing.

7. The edge sander according to claim 1, wherein said casing forms a bell housing that at least partially surrounds said sanding head.

8. The edge sander according to claim 7, further including an exhaust channel that leads from said bell housing.

9. The edge according to claim 8, wherein said exhaust channel terminates beyond said top surface of said casing.

10. A hand-held edge sander comprising:

a casing that holds and electric motor;

a sanding head that extends from said casing, wherein said sanding head is moved through a circular pattern by said electric motor and, wherein said sanding head retains a flat piece of sandpaper in a first plane;

wheels mounted to said casing for supporting said casing during operation of said edge sander, wherein said wheels rotate in a plane that is parallel said first plane causing said first plane to be vertically oriented when said wheels rest on a horizontal surface, and wherein said circular pattern and said wheels share a common tangent plane.

11. The edge sander according to claim 10, wherein said wheels include a set of primary wheels that rotate in a first common plane.

12. The edge sander according to claim 11, wherein said wheels further include a set of secondary wheels that rotate in a second common plane that is parallel to said first common plane.

13. The edge sander according to claim 10, further including at least one handle that extends from said casing.

14. The edge sander according to claim 10, wherein said casing forms a bell housing that at least partially surrounds said sanding head.

15. The edge sander according to claim 14, further including an exhaust channel that leads from said bell housing.

16. The edge sander according to claim 15, wherein said exhaust channel terminates above said casing.

17. The edge sander according to claim 10, further including an adjustment mechanism for selectively altering distances between said primary wheels and said casing.

* * * * *